United States Patent [19]

Sato et al.

[11] Patent Number: 5,020,462

[45] Date of Patent: Jun. 4, 1991

[54] SLACKENED NEEDLE THREAD ASSURING UNIT

[75] Inventors: Shuichi Sato; Yoshiharu Kobayashi; Shirou Ayusawa, all of Utsunomiya, Japan

[73] Assignee: SSMC Inc., Edison, N.J.

[21] Appl. No.: 395,835

[22] Filed: Aug. 18, 1989

[30] Foreign Application Priority Data

Sep. 30, 1988 [JP] Japan ..... 63-244258

[51] Int. Cl.[5] ..... B65H/57/08; D05B/53/00; D05B/65/00

[52] U.S. Cl. ..... 112/302; 112/253; 112/254; 112/292

[58] Field of Search ..... 112/253, 254, 255, 292, 112/300, 302

[56] References Cited

U.S. PATENT DOCUMENTS

| | | | |
|---|---|---|---|
| 972,894 | 10/1910 | Miller | 112/253 X |
| 2,981,214 | 4/1961 | Judet | 112/253 X |
| 3,191,562 | 6/1965 | Frankel | 112/300 X |
| 3,532,065 | 10/1970 | Marforio | 112/300 X |
| 3,610,188 | 10/1971 | Miller et al. | 112/292 |
| 4,879,960 | 11/1989 | Prais | 112/253 X |

FOREIGN PATENT DOCUMENTS

| | | | |
|---|---|---|---|
| 1059752 | 6/1959 | Fed. Rep. of Germany | 112/302 |

*Primary Examiner*—Peter Nerbun
*Assistant Examiner*—Paul C. Lewis
*Attorney, Agent, or Firm*—Theodore Jay

[57] ABSTRACT

A slackened needle thread assuring unit includes a thread tension member mounted on a side wall of a frame secured to the bed of a sewing machine. A thread takeup is positioned above the thread tension member. A needle/bobbin thread cutter is positioned apart from and under the frame for cutting a needle thread. A thread end holder holds an end of the thread to be cut by the needle/bobbin thread cutter. A thread guide extending across the front portion of the frame has one end supported by a support plate and the other free end defining a hook. A drive mechanism supported by the support plate reciprocally moves the hook in the direction substantially perpendicular to the threading direction of the needle thread. The hook hooks the thread threaded into the thread tension member, the thread takeup, and the needle

3 Claims, 3 Drawing Sheets

SLACKENED NEEDLE THREAD ASSURING UNIT

BACKGROUND OF THE INVENTION

1. Field of the Invention

The present invention relates to a slackened needle thread assuring unit capable of drawing out the needle thread necessary for a stitching operation.

2. Description of Prior Art

A known sewing machine is provided with a cutter for cutting a needle thread and a bobbin thread and with a thread end holder.

The cutter for cutting the needle thread and the bobbin thread permits a needle to be positioned at an upper stop position when the needle is raised from the surface of the sewn cloth after completion of the stitching operation and also permits a knife of the cutter to automatically cut off the needle and the bobbin threads at the position directly under the sewn cloth, namely, under a throat plate on which the sewn cloth is placed. The machine provided with the cutter is called a thread end cutting sewing machine. The thread end holder clamps the end portion of the needle thread which is cut off by the cutter to assure proper formation of a first stitch on the cloth to be sewn.

However, the prior art sewing machine is subject to a thread end breakage problem which can occur when the sewing operation is started from the state where by needle thread and the bobbin thread are cut off short. Then, the tension of the needle thread is abnormally increased and the end of the lower thread is drawn over the upper surface of the sewn cloth whereby the first stitch is not formed by a first needle hole, and in the worst case, the needle thread is cut off. This occurs because the turning angle of the upper shaft of the sewing machine increases to 70 degrees. Because of the structure of the sewing machine, the distance between a hole of the needle and a thread hole of the thread takeup is enlarged, causing a shortage in the slack of the needle thread when the needle is moved from the upper stop position to a lowering step at the start of the sewing operation. As a result, as manual finishing process is required after completion of the sewing operation. An end breakage can occur when an excessive tension is applied to the portion of the thread extended between the thread tension member and the needle hole via the thread takeup.

SUMMARY OF THE INVENTION

It is therefore an object of the present invention to provide a slackened needle thread assuring unit which can prevent a bobbin thread from being drawn over a surface of a sewn cloth.

It is a further object of the present invention to provide a slackened needle thread assuring unit which can form a desired stitch.

It is still a further object of the present invention to provide a slackened needle thread assuring unit which improves the working efficiency of a sewing machine.

The above and other objects, features and advantages of the present invention will become more apparent from the following description taken in conjunction with the accompanying drawings.

BRIEF DESCRITPTION OF THE DRAWINGS

DESCRIPTION OF THE PREFERRED EMBODIMENT

Figure 1:
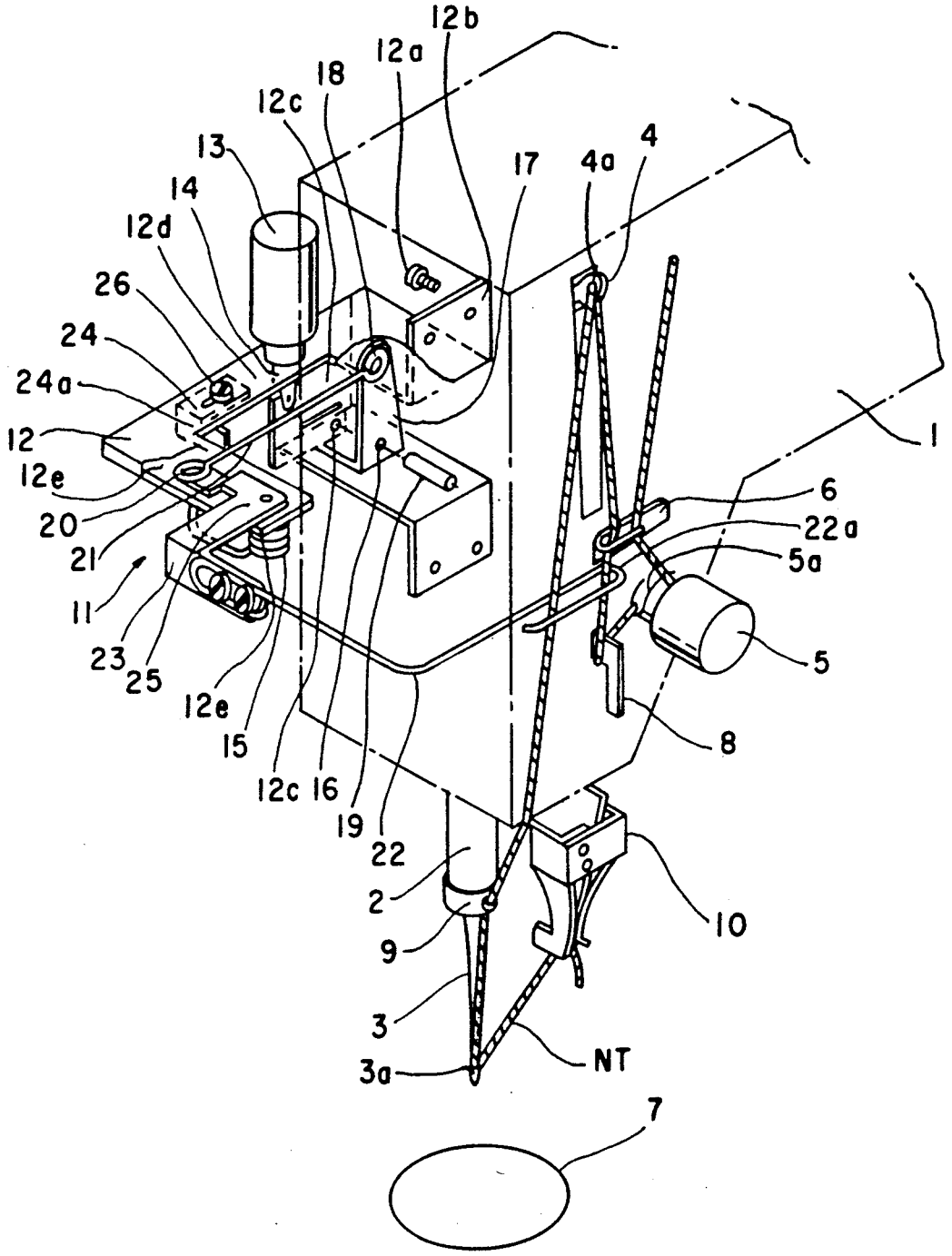
FIG. 1 is a perspective view of a slackened needle thread assuring unit according to an embodiment of the present invention.
Figure 2:
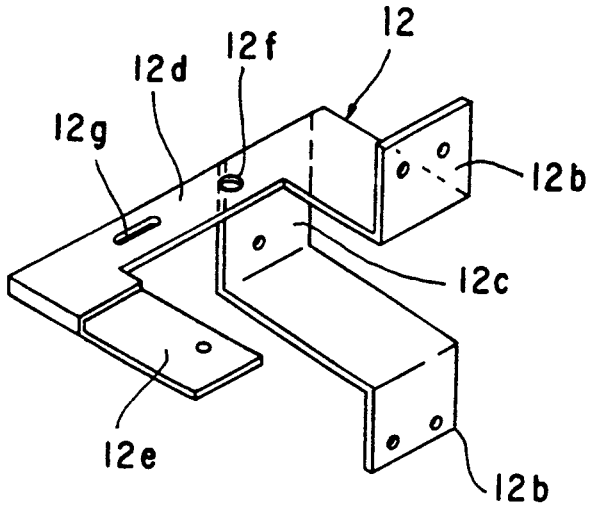
FIG. 2 is a perspective view showing a support plate, which is a constituent of the slackened needle thread assuring unit of FIG. 1.

A slackened needle thread assuring unit according to a preferred embodiment of the present invention will be described with reference to FIG. 1 and 2.

A slackened needle and thread assuring unit comprises a frame 1 mounted on a bed of a sewing machine. The frame 1 has front, side and bottom portions or walls. A needle bar 2 has a needle 3 and is mounted on the bottom portion of the frame 1. The bar is vertically driven with interlocking with a main shaft. A thread tension member 5 is mounted on the side portion of the frame 1 for applying to a needle thread NT (described later) a predetermined tension and also for drawing and drawing the needle thread NT upward. A thread takeup 4 is positioned above said thread tension member 5. Thread takeup 4 has a predetermined relative position with respect to the needle bar 2 and is vertically movable in a specific manner for allowing the needle thread NT to slacken at an appropriate value necessary for normal stitching operation during normal sewing operation and also to draw or tighten the needle thread NT. A support plate 12 is attached to the front portion of the frame 1. Needle thread NT is fed from a spool holder base mounted on a table of the sewing machine. Thread NT is successively wound between thread tension disks of the thread tension member 5 and supported elastically by a thread tension spring 5*a*. The thread NT thereafter passes through a middle thread guide 8, the thread end hole 4*a* of the thread takeup 4, and a thread guide 9 on the lower end of the needle bar 2, and reaches the thread and hole 3*a* of the needle 3. A needle/bobbin thread cutter 7 is positioned apart from and under the frame 1 for cutting the needle thread NT. A slackened needle thread assuring unit 11 is mounted on the frame 1 and is composed of a thread end holer 10 positioned adjacent to the needle bar 2 for holding the end of the thread which is cut by the needle/bobbin thread cutter 7. A thread guide 22 extends across the front portion of the frame 1 with one end supported by the support plate 12 and the other free end defining a hook 22*a*. Hook 22*a* hooks the thread threaded into the thread tension member 5, the thread and takeup 4, and the needle 3. A drive means is supported by the support plate 12 for reciprocally moving the hook 22*a* in the direction substantially perpendicular to the threading direction of the needle thread NT.

The arrangement will be described more in detail.

The slackened needle thread assuring unit 11 is disposed on the front surface of the frame 1. That is, a support plate 12 is provided on the front surface of the frame 1 by a plurality of set screws 12*a*. The support 12 comprises, as shown in FIG. 2, securing portions 12*b*, 12*b* to be secured to the frame 1, a vertical surface portion 12*c*, a horizontal surface portion 12*d*, and an auxiliary horizontal surface 12*e* positioned under the horizontal surface portions 12*d*. All of these portions are formed by bending a flat plate. The horizontal surface portion 12*d* has a hole 12*f* through which a solenoid 13 is secured thereto. The solenoid 13 has a cylinder rod (core) 14 extending downward under the horizontal surface portion 12*d* which is provided with a tip end rotatably connected to an end of a bell crank 17 by a pin. The bell crank 17 has holes 16 at the lower portion thereof through which a pin 19 is inserted. The pin 19 is rotatably supported by the vertical surface portion 12*c* of the support plate 12. A connecting link 21 has one end pivotally connected to an upper portion of the bell crank 17 by a pin 18 and the other end pivotally connected to one end of an operation arm 23 by a pin 20. The operation arm 23 has a middle portion pivotally connected to the auxiliary horizontal surface portion 12*e* of the support plate 12 by a hinge screw 25, one end secured to the auxiliary horizontal surface portion 12*e*, and the other end urged clockwise (in FIG. 1) by a spring 15 provided at the side of the other end of the operation arm 23. The operation arm 23 is always in an inoperative position when the cylinder rod 14 is under the horizontal surface portion 12*d* via the connecting link 21 and the bell crank 17. With such an arrangement, the drive means for reciprocally moving the thread guard 22 is structured.

The thread guide 22 of L-shape as a whole has a hook 22*a* formed by bending a tip end thereof in U-shape and has a base end detachably mounted on the other end of the operation arm 23. The hook 22*a* extends horizontally at the side portion of the frame 1 and is disposed across the passage of the needle thread NT extended between the thread tension member and the needle hole, namely perpendicularly across the needle thread NT. The hook 22*a* of the thread guard 22 hooks the needle thread NT extended between the thread tension member 5 and the thread hole 4*a* of the thread takeup 4, namely, between the thread guide 6 and the middle thread guide 8.

The stopper 24 restricts the length of movement of the hook 22*a* of the thread guard 22 and is attached under the horizontal surface portion 12*d* of the support plate 12 to be variable in its position.

The stopper 24 is secured to the horizontal surface portion 12*d* by a screw 26 inserted a long slit 12*g* provided in the horizontal surface portion 12*d* while a projecting wall 24*a* of the stopper 24 is opposed to one end of the operation arm 23 in the swinging direction of the operation arm 23 spaced in a predetermined distance. When the operation arm 23 is swung, one end thereof is brought into contact with the projecting wall 24*a* whereby the rate or the length of movement of the operation arm 23*a* is restricted. The rate of movement can be adjusted by sliding the securing position of the stopper 24 along the long slit 12*g*.

Figure 3:
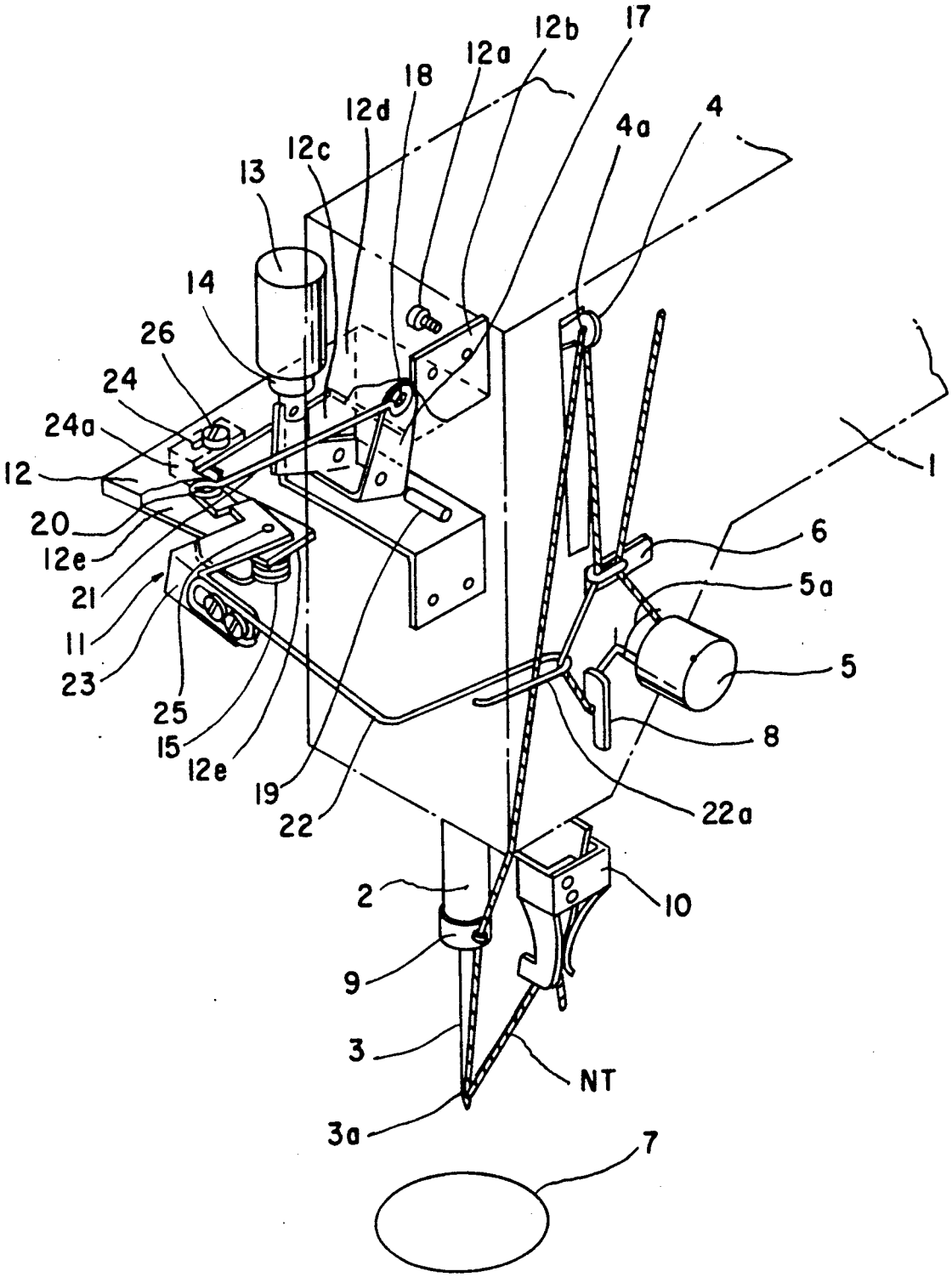
FIG. 3 is a very similar to FIG. 1 illustrating the operation of the slackened needle thread assuring units of FIG. 1.

An operation of the slackened needle thread assuring unit will be described with reference to FIG. 3.

After completion of sewing operation for one cloth, the needle bar 2 is stopped at the lower position for a while on the basis of an electric signal issued by a fixed position stopping unit (not shown) by the operation of a pedal etc., then at the same time when the needle bar 2 starts to move to the upper stop position by the operation of the thread and cutting control unit (not shown), the needle thread NT and the bobbin thread are automatically cut off by the knife of the needle/bobbin thread cutter 7 at the position under the sewn cloth on the basis of an electrical signal issued by a controller (not shown). Thereafter, an end of the needle thread NT thus cut off is held by the thread end holder 10 on the basis of the electric signal issued by the controller.

Just after the end of the needle thread NT is held by the thread end holder 10, the solenoid 13 is energized on the basis of the electric signal issued by the controller causing the cylinder rod 14 to be pulled against the resilient force of the spring 15 and to be positioned in the operative position. With a series of operations, as shown in FIG. 3, the bell crank 17 is turned about the pin 19 allowing the operation arm 23 and the thread guard 22 to turn clockwise about the hinge screw 25 via the connecting link 21. As a result, the hook 22*a* of the thread guard 22 moves forward perpendicularly to the needle thread NT. At this point, the operation arm 23 is brought into contact with the projecting wall 24*a* of the stopper 24 at one end thereof so that the movement of the operation arm 23 is restricted. With the horizontal movement of the hook 22*a* in the predetermined length, the needle thread NT having the thread end held by the thread end holder 10 is fed from the neeedle thread supply side, namely, from the spool holder base. Thereafter, when the solenoid is turned off, the operation arm 23 is turned by the resilient force of the spring 15 so that the thread guide 22 is moved backward. As a result, the feeding operation of the needle thread NT is completed thereby assuring sufficient slack of the needle thread NT for forming a normal first stitch. With the movement of the operation arm 23, the cylinder rod 14 is projected upward to return to the inoperative position.

When the securing position of the stopper 24 is moved along the long slit 12*g* by operation of the screw 26, the rate or angle of the turning of the operation lever 23 bringing into contact with the projecting wall portion 24*a* will be increased or decreased whereby the horizontal movement of the hook 22*a* of the thread guide 22 is changed so that the feeding length of the upper thread NT is changed. As a result, the amount of slack appropriate for forming the first stitch is assured.

Accordingl to the present embodiment, the hook 22*a* of the thread guide 22 hooks the upper thread NT extended between the thread takeup 4 and the thread tension member 5, but may hook the needle thread NT extended between the thread takeup 4 and the needle 3 to permit the needle thread NT to be fed from the spool holder base. Furthermore, the hook 22*a* of the thread guide 22 can be constituted to be horizontally reciprocally moved directly by the solenoid as the drive means.

With the arrangement of the upper thread and supply assuring unit according to the present invention, inasmuch as the needle thread necessary for forming the first stitch is appropriately assured, there are certain advantages. In the first place the bobbin thread is prevented from drawing over the surface of the sewn cloth because of shortage of slack of the needle thread. Secondly the desired stitch made by the needle thread and the bobbin thread which are well balanced can be formed from the first stitch. Thirdly the working efficiency can be remarkably improved by eliminating the manual mending operation which can take place after completion of the sewing operation and the inconvenience of the cut caused by the shortage of the slack of the needle thread.

Although the invention has been described in its preferred form with a certain degree of particularity, it is to be understood that many variations and changes are possible in the invention without departing from the scope thereof.

What is claimed is:

1. A slackened needle thread assuring unit for a sewing machine, the sewing machine having a bed, the unit comprising a frame secured to the bed, said frame having front side and bottom walls;

a needle bar having a needle and mounted on the bottom wall of the frame;

a thread tension member mounted on the side wall of said frame;

a thread takeup positioned above said thread tension member on the side wall;

a support plate attached to the front wall of said frame;

a needle thread successively threaded into the thread tension member, the thread takeup, and the needle;

a needle/bobbin thread cutter disposed in spaced apart position from and under the frame for cutting the needle thread;

a thread end holder positioned adjacent to the needle bar for holding an end of the thread to be cut by the needle/bobbin thread cutter;

a thread guide extending across the front wall of said frame having one end supported by said support plate and another free end defining a hook, said hook being adapted for threading the thread into the thread tension member, the thread takeup, and the needle; and a drive means supported by the support plate for reciprocally moving the hook in a direction substantially perpendicular to a threading direction of the needle thread.

2. A slackened needle thread assuring unit according to claim 1 further including a stopper adjustably attached to the support plate and positioned adjacent the thread guide for restricting the reciprocal movement of the hook.

3. A slackened needle thread assuring unit according to claim 2, wherein a securing position of the stopper can be adjusted by moving the stopper along a long slit provided at the support plate by a screw.

* * * * *